United States Patent [19]

Cerruti

[11] Patent Number: 4,654,652

[45] Date of Patent: Mar. 31, 1987

[54] DEVICE FOR VISUALLY DISPLAYING ALPHANUMERIC CHARACTERS, PARTICULARLY IN MOTOR VEHICLES

[75] Inventor: Eraldo Cerruti, Turin, Italy

[73] Assignee: Fiat Auto S.p.A., Turin, Italy

[21] Appl. No.: 577,832

[22] Filed: Feb. 7, 1984

[30] Foreign Application Priority Data

Feb. 14, 1983 [IT] Italy ..... 52941/83[U]

[51] Int. Cl.[4] ..... G09G 3/04

[52] U.S. Cl. ..... 340/756

[58] Field of Search ..... 340/756, 752, 758, 759, 340/762, 766, 790, 784, 781, 785

[56] References Cited

U.S. PATENT DOCUMENTS

| | | | |
|---|---|---|---|
| 1,118,650 | 11/1914 | Hultish | 178/113 |
| 4,237,459 | 12/1980 | Cordova | 340/756 |
| 4,260,987 | 4/1981 | Osman | 340/756 |
| 4,261,126 | 4/1981 | Bezjian | 340/736 X |
| 4,323,893 | 4/1982 | Ypsilantis et al. | 340/756 |
| 4,368,464 | 1/1983 | Azzam | 340/756 |
| 4,394,651 | 7/1983 | Frankston et al. | 340/756 |

FOREIGN PATENT DOCUMENTS 2071386 9/1981 United Kingdom .

*Primary Examiner*—Marshall M. Curtis
*Assistant Examiner*—Vincent P. Kovalick
*Attorney, Agent, or Firm*—Morgan & Finnegan

[57] ABSTRACT

A device for visually displaying alphanumeric characters by means of segments which are individually and selectively switchable between two operating states, one of which corresponds to visual perceptability of the segments themselves. The segments are arranged in identical, adjacent groups forming a repeating structure, wherein each group comprises first segments together defining a main configuration including two quadrilateral-shaped spaces arranged one above the other and open on their right-hand sides, second segments defining first and second subsidiary configurations disposed respectively at the lower left-hand corner, and the upper left-hand corner of the main configuration and each including a segment which extends substantially vertically from a respective corner of the main configuration itself, two third segments one of which occupies the upper left-hand portion of the lower quadrilateral-shaped space of the main configuration, and the other of which is located below the lower right-hand corner of the main configuration.

7 Claims, 15 Drawing Figures

Figure 5:
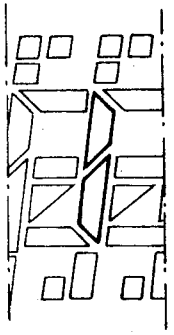

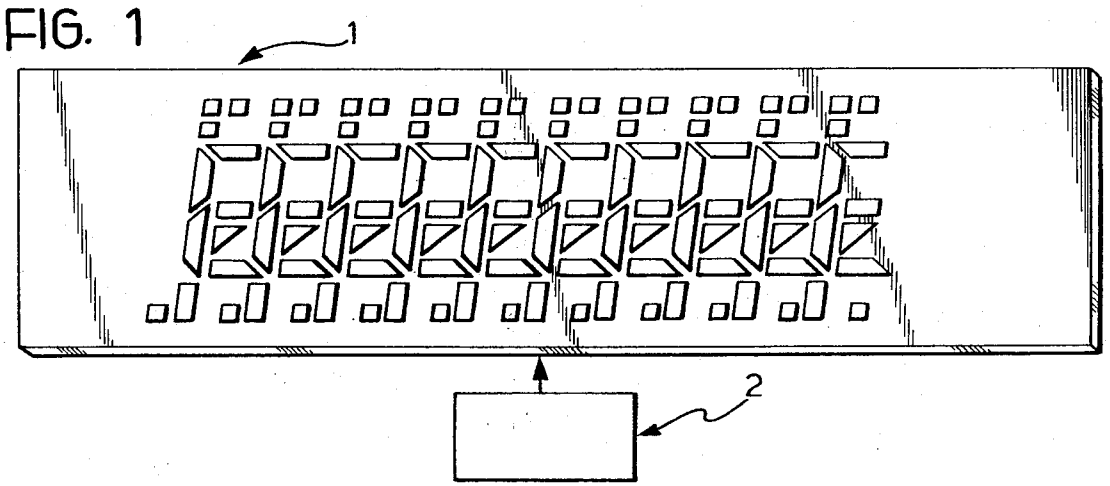
FIG. 1
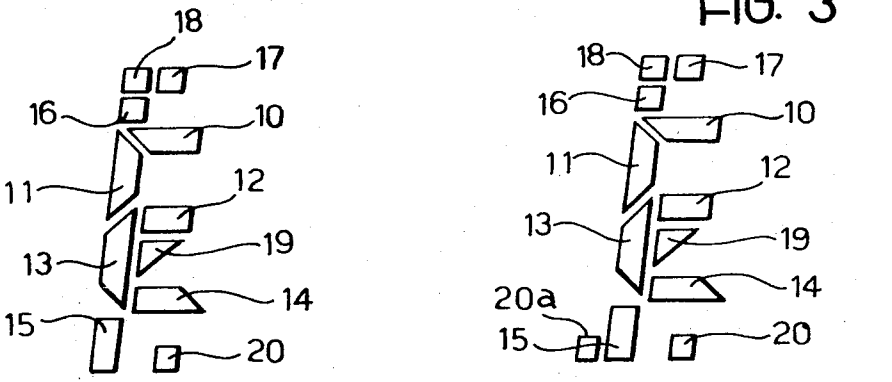
FIG. 2
FIG. 3
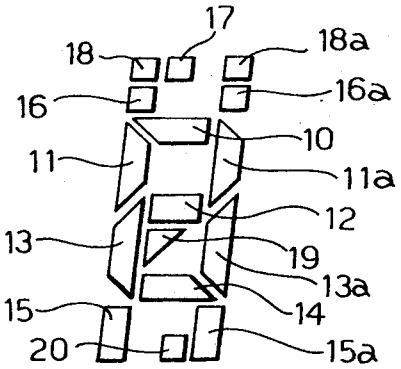
FIG. 4

DEVICE FOR VISUALLY DISPLAYING ALPHANUMERIC CHARACTERS, PARTICULARLY IN MOTOR VEHICLES

The present invention relates to devices for visually displaying alphanumeric characters and in particular relates to a device in which the visual display of the alphanumeric characters is achieved by means of segments which are individually and selectively switchable between two operating states, one of which corresponds to visual perceptability of the segments themselves.

Numerous examples are known in the art of alphanumeric visual display devices suitable for use in vehicles, both on the ground and in the air.

A first example of devices of the type indicated above is constituted by devices which use cathode ray tubes (CRT) and which are basically similar to those generally used in video terminals of electronic processors. In these devices, each character is reproduced by means of a matrix of luminous points which, when activated, define the overall form of the character. These devices suffer from the disadvantage of being rather expensive and, in addition, the display unit is delicate and vulnerable.

These disadvantages are partially overcome by the use of visual display units employing light emitting diodes (LED) or, more recently, liquid crystals, these units being similar to those which are very widely used today in so-called digital watches and pocket calculators.

The visual display units mentioned above are generally termed "seven-segment" units since they include seven segments which are either light emitting or can be made visually perceptable, and which define two spaces, usually quadrilateral in shape, located one above the other. These units allow the visual display of all the Arabic numbers as well as several letters of the alphabet (mostly capitals) with which alarm or error messages can be associated.

These visual display devices are not really suitable for the generalised presentation of numbers and letters of the alphabet, particularly lower case alphabet letters. In order to provide this display versatility it is necessary to revert to the "point" system described previously which generally cannot be implemented in a small visual display unit because of the need to selectively activate a large number of points for each character.

The object of the present invention is to provide a device of the type specified above which does not have the disadvantages described above and is simple and efficient to use particularly in motor vehicle applications.

In order to achieve this object, the present invention provides a device of the type specified above characterised in that the said segments are arranged in identical, adjacent groups forming a repeating structure, each group comprising:

first segments together defining a main configuration including two quadrilateral-shaped spaces arranged one above the other and open on their right-hand sides, second segments defining first and second subsidiary configurations disposed respectively at the lower left-hand corner, and the upper left-hand corner of the main configuration and each including a segment which extends substantially vertically from a respective corner of the main configuration itself; the second subsidiary configuration further including a horizontal segment which extends towards right as an extension of the substantially vertical segment and a corner segment occupying the corner position of the second configuration itself, two third segments one of which occupies the upper left-hand portion of the lower quadrilateralshaped space of the main configuration, and the other of which is located below the lower right-hand corner of the main configuration in a position substantially horizontally aligned with the lower end of the first subsidiary configuration, and means for selectively controlling the switching of each of the first, second and third segments into the state of visual perceptability.

By virtue of this characteristic a device is provided which allows all the lower-case letters of the alphabet and several arithmetic signs to be displayed efficiently in addition to Arabic numerals. In addition to this, the presentation of the Arabic numerals is significantly improved, which makes their identification easier avoiding several of the errors which are frequently caused by the use of "seven-segment" units.

The advantages of the invention will become clear from the description which follows, given purely by way of non limiting example, with reference to the appended drawings, in which:

FIG. 1 is a general view of a device according to the invention having a repeating display-segment structure.

Figure 13:
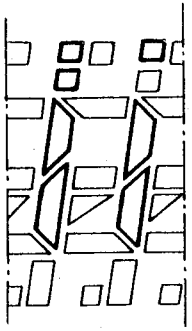
Figure 14:
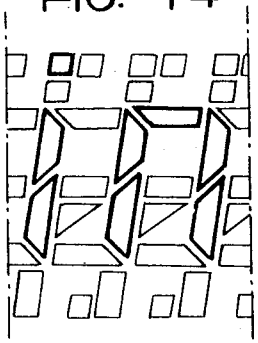
Figure 15:
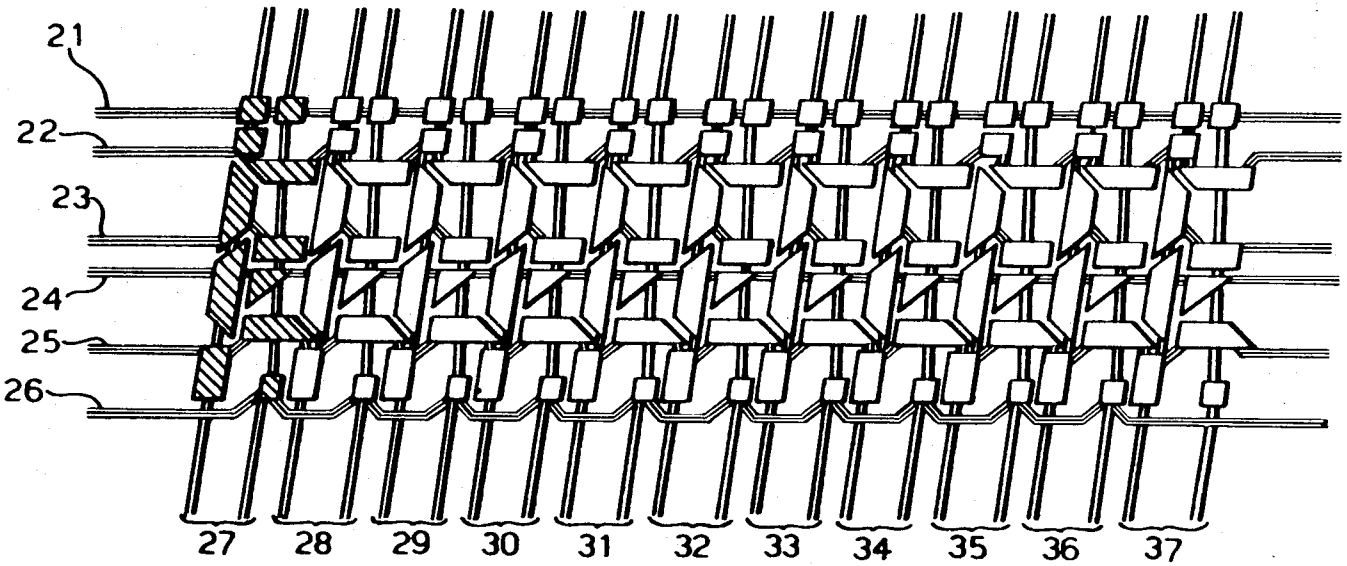

FIG. 2 illustrates one of the groups of segments forming the repeating structure illustrated in FIG. 1, FIGS. 3 and 4 illustrate the groups of segments which occupy the end positions of the repeating structure of FIG. 1, FIGS. 5 to 14 illustrate several examples of use of the device according to the invention, and FIG. 15 illustrates one possible connection arrangement for the device illustrated in FIG. 1.

FIG. 1 shows generally a flat visual display screen 1 of a device according to the invention.

On the surface of the screen 1 are a plurality of surface segments arranged in a repeating structure.

Each surface segment is individually and selectively switchable between two operating states, one of which corresponds to visual perceptability of the segment itself.

The switching of each segment to its state of visual perceptability is controlled by a supply source generally indicated 2.

The screen 1 may be formed by any of the methods currently used for the manufacture of visual display units, such as, for example, light emitting diode technology (LED), vacuum fluorescent technology (VF) or liquid crystal technology (LCD=liquid crystal display).

In all the cases mentioned the source 2 is constituted by an electrical source capable of producing a state of polarisation in each surface segment present on the screen 1.

When the segments are formed by light emitting diode technology (LED) or vacuum fluorescent technology (VF), switching to the polarised state results in the whole surface of a segment becoming luminous and thus distinguishable from the extreme darkness of the screen.

When liquid crystal technology is employed, switching to the polarised state produces a variation in the refractive index of the entire segment which takes on a uniformly light colour, clearly contrasting with the opacity and the generally dark colour of the screen or vice versa.

The detailed specification of the characteristics of the supply source 2 and of the criteria for connecting it to the surface segments of the screen 1 is a question of design which can be solved by an expert in this field.

As indicated above, the surface segments present on the screen 1 are arranged in identical groups disposed very close to each other such as to form a continuous repeating structure extending in a horizontal direction on the surface of the screen 1.

The basic structure of each of these groups is illustrated in FIG. 2.

In this Figure first segments, progressively numbered from 10 to 14, together form a main configuration which defines two quadrilateral-shaped spaces located one above the other and open on their righthand sides.

The first segments 10 to 14 basically correspond with five of the seven segments of the "seven-segment" displays at present in use for presenting Arabic numerals. Taking account of the fact that the surface segment present on the screen 1 are arranged in a repeating structure, the segments 10 to 14 allow the display of all of the Arabic numerals as is illustrated in FIG. 5 with reference to the numeral "1" in which, as in the other Figures, the activated segments are indicated by outlining.

The group illustrated in FIG. 2 further includes a second collection of segments indicated by numerals 15 to 18, defining first and second subsidiary configurations.

In the example described, the first subsidiary configuration includes a single segment indicated 15 which extends substantially vertically from the lower left-hand corner of the main configuration defined by the segments 10 to 14.

The second subsidiary configuration, which is generally L-shaped, is disposed at the upper left-hand corner of the said main configuration. The second configuration includes a segment 16 which extends substantially vertically from the upper left-hand corner of the main configuration defined by the segments 10 to 14. A horizontal segment 17 projects towards right i.e. towards the vertical centre line of the main configuration as an extension of the segment 16. A corner segment 18 is interposed between the segment 16 and the segment 17. The segment 18 thus occupies the corner position of the second configuration itself.

Figure 6:
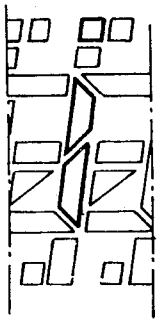

FIG. 6 illustrates the use of the segment 18 which is activated together with the segments 11 and 13 to achieve the presentation of the letter "i".

References 19 and 20 indicate two further segments the first of which (19) is triangular and occupies the upper left-hand portion of the quadrilateral-shaped space defined by the segments 12, 13, 14, that is, the lower quadrilateral -shaped space of the main configuration defined by the segments 10 to 14. Preferably, the longer side of the segment 19 extends along the longer diagonal of this quadrilateral-shaped space. The segment 20 is, in contrast, located below the segment 14, in a position substantially horizontally aligned with the lower end of the segment 15, in correspondence with the lower right-hand corner of the main configuration defined by the segments 10 to 14.

The use of the segments 19 and 20, together with that of the other segments is shown, by way of example, in FIGS. 7 to 11.

Figure 7:
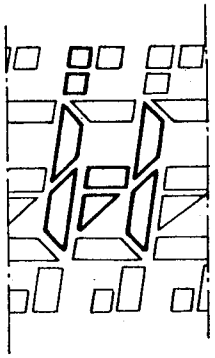

In particular, FIG. 7 shows the display of the character "k" the presentation of which is achieved by the simultaneous activation of the segments 11, 12, 13, 16, 18 and 19 of one of the groups forming the repeating structure, and the segments 11 and 13 of the adjacent group on the right.

Figure 8:
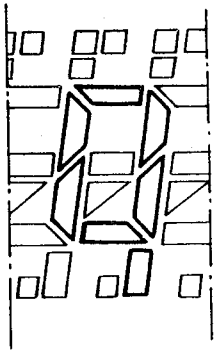
Figure 9:
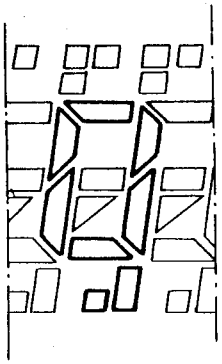

The display of the letters "q" and "g", illustrated in FIGS. 8 and 9 is achieved by the activation, in addition to the segments 10, 11, 13, 14 (and in the case of the "g", 20) of one group, of the segments 11, 13, 15 of the adjacent group on the right.

Figure 10:
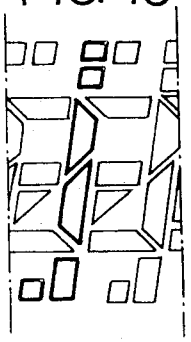
Figure 11:
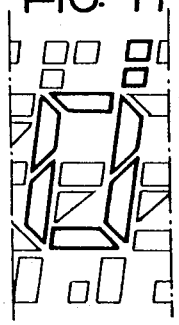

FIGS. 10 and 11 illustrate the presentation of the characters "j" and "d".

The presentation of the character "j" is achieved by the simultaneous activation of the segments 11, 13, 15, 16 and 18 of one group and the segment 20 of the adjacent group on the left.

The presentation of the character "d" is, however, obtained by the simultaneous activation of the segments 10, 11, 13 and 14 of one group and the activation of the segments 13, 16 and 18 of the adjacent group on the right.

The presentation of a single character may thus require the simultaneous activation of segments belonging to different groups.

For this purpose, in order to allow the presentation of all the characters even in the end positions of the screen 1, the groups of segments occupying the left-hand and right-hand end positions of the repeating structure may be provided with auxiliary segments.

The group occupying the left-hand end position, illustrated in FIG. 3, has an auxiliary segment indicated 20*a* which is located outside the group on the left-hand side thereof, in a position substantially in alignment with the lower end of the segment 15.

The auxiliary segment 20*a* thus constitutes, so to speak, a sort of "left over" of an adjacent group to the left of the said end group.

In a substantially similar manner, the group, illustrated in FIG. 4, which occupies the right-hand end position of the visual display structure of the screen 1, has further segments 11*a*, 13*a*, 15*a*, 16*a*, 18*a* aligned along the right-hand side of the group itself. These auxiliary segments are used for the representation of characters such as "d" or "i" in the right-hand end position of the screen 1.

Figure 12:
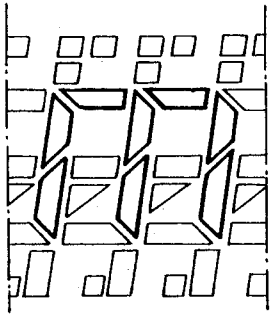

FIG. 12 illustrates the presentation of the character "m", which involves three groups of segments with the segments 10, 11 and 13 being activated in two adjacent groups and the segments 11 and 13 being activated in the group occupying the position to the right in the overall configuration.

FIGS. 13 and 14 illustrate the presentation of groups of two letters, that is, the group "li" and the group "in".

A more complete illustration of the manner of representation of Arabic numerals and lower-case alphabet letters by means of the device according to the invention is to be found in the drawings of Italian design application No. 52942-B/83 filed Feb. 14, 1983.

FIG. 15 illustrates schematically the segments of the visual display screen 1, together with the network of connecting lines terminating at the source 2 which enables a state of polarisation to be selectively produced in each surface segment present on the screen 1. In the example illustrated, the surface segments on the screen 1 are arranged in a repeating structure comprising eleven groups of segments similar to that illusrated in FIG. 2 and identical to each other.

Successive references 21 to 26 indicate six connecting lines each of which connects together segments occupying corresponding positions in the eleven groups forming the said repeating structure.

More particularly, line 21 connects with the segments 17 and 18 of all the groups of the structure, while lines 22 and 23 respectively connect with all the segments 10 and 16 and all the segments 11 and 12 on the screen 1.

Similarly, the line 24 connects with all the segments 13 and 19 while the line 24 connects with all the segments 14 and 15. Finally the line 26 connects all the segments 20.

Successive references 27 to 37 indicate eleven pairs of connecting lines, each pair enabling the selective polarisation of the segments in one of the eleven identical groups forming the repeating structure. In particular, for each pair, the segments indicated 11, 13, 15, 16 and 18 connect with one of the lines while the segments indicated 10, 12, 14, 17, 19 and 20 connect with the other.

The arrangement is such that each of the segments present on the screen 1 is connected to only one of the lines 21 to 26 and to only one of the lines 27 to 37, in accordance with a matrix addressing scheme in which the polarisation of each segment is controlled by the source 2 through a signal applied to a unique pair of connecting lines.

Thus for example, the polarisation and the visual perceptability of the segment 12 in the group furthest to the left in FIG. 15 can be achieved by the application of a polarisation signal between the line 23 and the line occupying the right-hand position of the pair indicated 27.

The illustration provided by FIG. 15 is schematic since both the manner of formation of the lines 21 to 26, 27 to 37 (for example by metallisation on one or both faces of the screen 1) and the topological organisation of the lines themselves, vary in dependence on the technology (LED, LCD, vacuum fluorescent etc.) used for the manufacture of the screen 1. The adaption of the parameters of the connecting lines to a particular technology is a question of design which can be solved by an expert in this field.

The connection configuration described facilitates the connection of the screen 1 to the supply source. In particular, in order to reduce the power used by the screen 1 it is possible (in known manner) to provide the source 2 with a multiplexer having the same number of outputs as the number of connecting lines (six, in the case of the lines 21 to 26) connecting corresponding segments in different groups of the repeating display structure. The purpose of the multiplexer is to cause the polarisation signals which are to be applied to the segments through these lines (21–26), to be applied to only one line at a time in a cyclic manner instead of being applied simultaneously to all the lines concerned.

For example, in presenting a letter "i" (FIG. 6) by means of the segments 11, 13 and 18 of any one group of the repeating structure, instead of supplying (together with the corresponding line selected from the lines 27 to 37) the lines 21, 23 and 24 simultaneously with each other, the multiplexer cyclically supplies the line 21 alone, the line 23 alone, the line 24 alone, and then supplies the line 21 alone again and so on.

The sequential supply of the lines 21 to 26 cannot be perceived by the observer since the period of the supply cycle is less than the average time of persistence of the images on the retina (typical value 1/16 second).

If a scheme for multiplexing the supply to the lines 27 to 37 is effected it is also possible (in known manner) to generate a "running" effect of the symbols and of the writing presented on the screen 1.

Naturally, the effects of the present invention also extend to models which allow equal utility to be achieved by using the same innovative concept and in particular to models in which the segments 10–20 have a different form from the polygonal form illustrated in the drawings appended to the present specification.

I claim:

1. A device for visually displaying alphanumeric characters comprising at least ten segments which are individually and selectively switchable between two operating states, one of which corresponds to visual perceptibility of the segments themselves, wherein the segments are arranged in identical, adjacent groups forming a repeating substantially horizontal structure from left to right, each group comprising:

at least five first segments together defining a main configuration including two quadrilateral-shaped spaces arranged one above the other and open on the right sides, wherein each of three substantially horizontal segments are positioned one above the other to form the horizontal sides of the two adjacent quadrilateral-shaped spaces and each of two substantially vertical segments are positioned one above the other to form the left vertical sides of the two adjacent quadrilateral shaped spaces;

second segments defining first and second subsidiary configurations disposed respectively at the lower left corner, and the upper left corner of the main configuration and each including a parallelogram shaped segment which extends substantially vertically from and adjacent to a respective corner of the main configuration itself, the second subsidiary configuration further including an additional parallelogram shaped segment extending substantially vertically from said adjacent vertically extending segment and a horizontal segment which extends right as an extension of said additional substantially vertical segment;

two third segments one of which occupies the upper left portion of the lower quadrilateral-shaped space of the main configuration, and the other of which is located below the lower right corner of the main configuration, in a position substantially horizontally aligned with the lower end of the first subsidiary configuration; and means for selectively controlling the switching of each of the first, second and third segments into a state of visual perceptibility.

2. A device according to claim 1, wherein the group occupying the extreme left position of the repeating structure includes a further segment disposed to the left of this group, outside the group itself, and adjacent the lower end of the first subsidiary configuration.

3. A device according to claim 1, wherein the group occupying the extreme right side of the repeating structure includes further segments aligned substantially vertically one above another, two of these further segments enclosing the right side of the quadrilateral-shaped spaces of the main configuration which are arranged one above the other, another two of the further segments and a final one of the further segments being disposed at the upper right corner and the lower right corner respectively of the main configuration.

4. A device according to claim 1, wherein the means for selectively controlling the switching of the segments into their visually perceptible states include connecting lines defining a matrix addressing arrangement for the segments in which the switching of each segment is controlled by signals applied to the segment itself through a predetermined pair of the connecting lines.

5. A device according to claim 1, including first connecting lines each of which interconnects corresponding segments in different groups of the repeating structure, and second connecting lines each of which connects with only one of the segments within said groups.

6. A device according to claim 5, wherein the means for controlling the switching of the segments to a state of visual perceptibility include a multiplexer connected to the first connecting lines to sequentially supply these lines in a cyclic manner, the cycle period being less than the average time of persistence of images on a human retina.

7. A device according to claim 1, wherein a triangular shaped element is positioned below the middle substantially horizontal segment of the three horizontal segments defining the main configuration and to the right of the lower substantially vertical segment of the main configuration, wherein two sides of the triangle are substantially parallel to said substantially horizontal and vertical segments.

* * * * *